United States Patent [19]

Kohlstette et al.

[11] 4,417,885

[45] Nov. 29, 1983

[54] CENTRIFUGE WITH VERTICAL AXIS OF ROTATION

[75] Inventors: Werner Kohlstette; Willi Niemerg, both of Oelde, Fed. Rep. of Germany

[73] Assignee: Westfalia Separator AG, Oelde, Fed. Rep. of Germany

[21] Appl. No.: 434,220

[22] Filed: Oct. 14, 1982

[30] Foreign Application Priority Data

Oct. 22, 1981 [DE] Fed. Rep. of Germany ..... 3141888

[51] Int. Cl.[3] ..... B04B 15/00

[52] U.S. Cl. ..... 494/23; 494/38

[58] Field of Search ..... 494/23, 25, 26, 38, 494/39, 41, 56, 58, 60, 63, 76

[56] References Cited

U.S. PATENT DOCUMENTS 3,494,545 2/1970 Nilson ..... 494/26

FOREIGN PATENT DOCUMENTS 2737463 2/1979 Fed. Rep. of Germany .

3006220 6/1981 Fed. Rep. of Germany .

*Primary Examiner*—Robert W. Jenkins

*Assistant Examiner*—Arthur D. Dahlberg

*Attorney, Agent, or Firm*—Sprung, Horn, Kramer & Woods

[57] ABSTRACT

A centrifuge that has a vertical axis of rotation and that is intended for separating or clarifying mixtures of liquids has a drum with a skimming compartment that accommodates a skimmer for diverting a clarified or separated liquid phase. Above the skimming compartment is a blocking compartment that can be filled with a blocking fluid into which a sealing disk that is rigidly connected to the skimmer is immersed and that is intended to prevent atmospheric air from getting into the skimming compartment. The skimmer and sealing disk are positioned in the compartments at a certain distance from the rotating components of the drum. The portions of the compartments communicate with each other that are below the sealing disk and above the skimmer and are connected to a channel through which a gas that is under higher-than-atmospheric pressure can be supplied to the chambers to prevent blocking fluid from squirting out of the blocking compartment into the skimming compartment.

2 Claims, 1 Drawing Figure

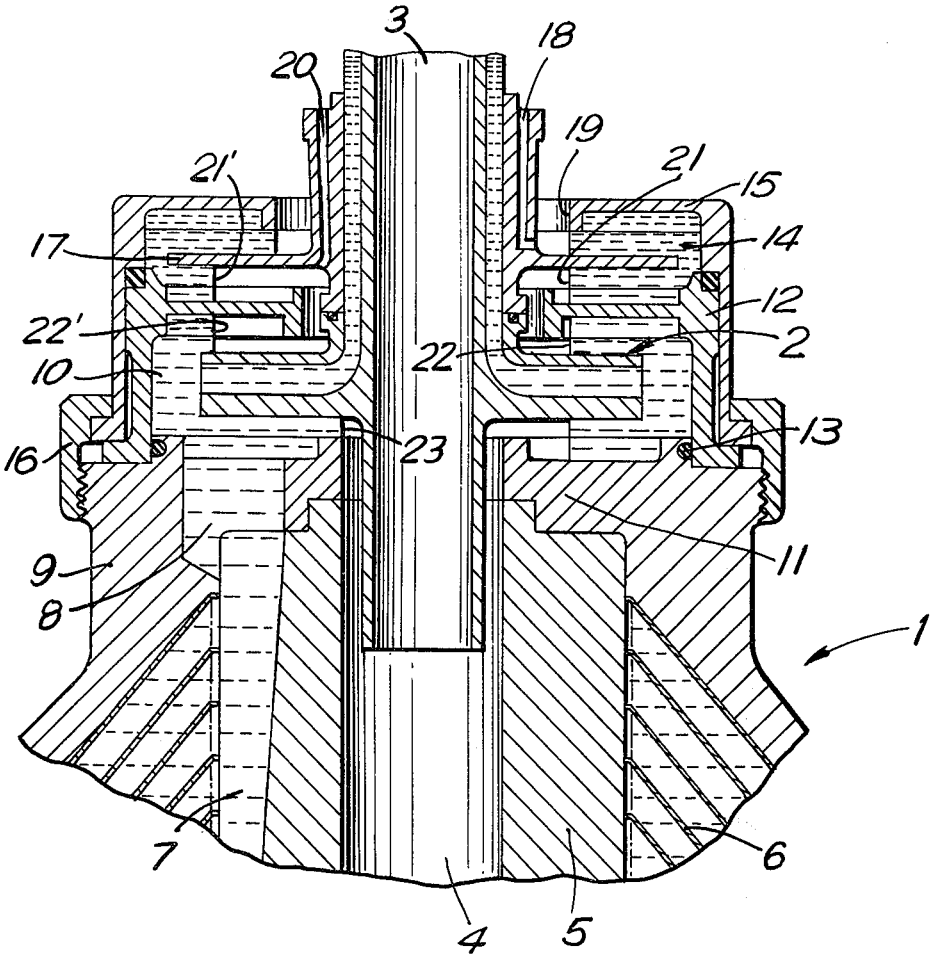
3
18
20
19
21'
21
15
17
14
12
22'
22
2
10
13
16
23
11
9
8
1
7
6
4
5

CENTRIFUGE WITH VERTICAL AXIS OF ROTATION

BACKGROUND OF THE INVENTION

The invention relates to a centrifuge with a vertical axis of rotation, with at least one skimmer that is accommodated in a skimming compartment in the centrifuge drum and that continuously diverts a liquid phase being clarified or separated in the drum, with a sealing disk that is rigidly connected to the skimmer above the skimming compartment, that extends into a blocking compartment rotating along with the drum and that can be filled with a blocking fluid, and wherein the skimmer is stationary and with the sealing disk are positioned at a distance from the rotating components of the drum.

Such a centrifuge is known from German Offenlegungsschrift 2 737 463. Centrifuges of this type are mostly employed to clarify or separate liquids that are sensitive to air and that must be kept away from bacteria. The sealing disk that is immersed in a blocking fluid above the skimming compartment is intended to prevent atmospheric air from entering the skimming compartment and hence the liquid being diverted from the compartment by the skimmer.

A fluid called a foreign fluid, because it is independent of the product being centrifuged, is usually employed as a blocking fluid in the blocking compartment because this compartment is in contact with the atmosphere and it is impossible to avoid at least some air getting into it.

Powerful eddies do, however, occur in the blocking compartment because of the stationary sealing disk being immersed in a rotating blocking fluid, causing the fluid to squirt into the skimming compartment, which is below the blocking compartment, and mix with the liquid being diverted from it. Thus, the effectiveness of clarifying or separation is powerfully affected by the foreign fluid.

Preventing the fluid from squirting out of an upper skimmer compartment into another skimming compartment below the first by positioning a catcher compartment below the first skimming compartment to return the overflow to the drum-feed space is known from German Auslegeschrift 3 006 200. A design of this type can only be employed, however, when the blocking fluid is the liquid phase being clarified or one of the liquid phases being separated, so that a certain amount of air getting in is acceptable.

SUMMARY OF THE INVENTION

The object of the present invention is to provide a centrifuge of the type described above, but in which not even slight amounts of fluid, especially foreign fluid, can squirt out of the blocking compartment into skimming chamber below it.

This objective is attained in accordance with the invention because the compartments that are positioned below the sealing disk and above the skimmer and that communicate with each other are connected to a channel through which a gas that is under a higher-than-atmospheric pressure can be supplied to the compartments.

Supplying a gas that is under a higher-than-atmospheric pressure to the compartments shifts the interior levels of fluid in the blocking compartment below the sealing disk and in the skimming compartment above the skimmer to the periphery of the drum in accordance with the pressure of the gas. This means that the interior fluid levels above the sealing disk and below the skimmer can be displaced in toward the axis of the drum much more than would ordinarily be possible.

Displacing the interior level of a fluid under a certain pressure below the sealing disk to the periphery of the drum decreases the depth to which the bottom of the sealing disk is immersed, minimizng the eddies in the compartment and preventing the blocking fluid from squirting over into the skimming compartment underneath. The interior fluid level on the top of the sealing disk can be at the same time be shifted toward the axis of the drum, increasing the depth to which the disk is immersed on this side and improving the seal against the atmosphere.

Imposing a gas under higher pressure on the level of fluic above the skimmer in the skimming compartment can also, surprisingly, increase the discharge pressure in the skimmer or, at constant discharge pressure, allow the outside diameter of the skimmer to be shorter, considerably decreasing the centrifuge's power consumption.

When clarifying beverages like beer and wine, a gas like carbon dioxide, which is frequently used to prevent liquids of this type from oxidizing, can be superimposed.

BRIEF DESCRIPTION OF THE DRAWING

One embodiment of the invention will now be specified with reference to the drawing, which shows the interior fluid level below the blocking compartment and above the skimming compartment, the right half without a superimposed gas and the left half with a superimposed gas.

DETAILED DESCRIPTION OF THE INVENTION

A skimmer 2 is mounted stationary on a dome (not illustrated) inside the drum 1 of a clarifying centrifuge at a distance from the rotating components of the drum. The skimmer has a central inlet 3 through which the liquid that is to be clarified of solids is supplied, flowing into the feed space 4 of a distributor 5 and through a plate assembly 6 mounted on the distributor and where it is clarified. Whereas the centrifuged solids are propelled into the outer sludge space of the drum, the clarified liquid flows through plate assembly 6 toward the axis of the drum and then through channel 7 and outlet 8 in the cover 9 of the drum into the skimming compartment 10. The bottom of skimming compartment 10 is delimited by an annular projection 11 on drum cover 9 and its top by an annular compartment 12 that is sealed off from cover 9 with a sealing ring 13. Stationary skimmer 2, which diverts the clarified liquid, is positioned inside the skimming compartment at a certain distance from the rotating components of the drum.

There is a blocking compartment 14 above skimming compartment 10. Its bottom is delimited by annular compartment 12 and its top by a cover 15 that is tightly connected to the cover 9 of the drum with a lock ring 16 and sealed off from annular compartment 12. There is a sealing disk 17 inside blocking compartment 14 that is tightly attached to stationary skimmer 2 and also positioned at a certain distance from the components of the drum.

A blocking fluid can be applied to blocking compartment 14 above sealing disk 17 through a channel 18 in the shank of the disk so that excess fluid can escape from the compartment over the inner edge 19 of cover 15.

There is in accordance with the invention a channel 20 in the shank of sealing disk 17 that opens into communicating compartments 14 and 10 below sealing disk 17 and above skimmer 2. A gas can be introduced into these compartments through channel 20 under a higher-than-atmospheric pressure to force the inner fluid at the level 21 (shown on the right side of the drawing) under sealing disk 17 to assume the level 21' (on the left side of the drawing) and the inner fluid at the lever 22 above skimmer 2 to assume the level 22' toward the periphery of the drum.

Shifting the fluid from level 21 to level 21' below sealing disk 17 allows the blocking-fluid overflow edge 19 on cover 15 to be shifted farther toward the axis of the drum. Shifting the fluid from inner level 22 to inner level 22' above skimmer 2, allows inner fluid level 23 below skimmer 2 to be displaced to the inside diameter of annular projection 11 on drum cover 9 by appropriate choking of the fluid running off the skimmer.

It is of course conceivable, when the centrifuge is a separating centrifuge with two skimmer disks and skimming compartments for diverting the separated fluid, to also provide a channel with a gas connection in which the gas is directed between the two skimmer disks to prevent overflow from the upper to the lower skimming compartment.

It will be appreciated that the instant specification and claims are set forth by way of illustration and not limitation, and that various modifications and changes may be made without departing from the spirit and scope of the present invention.

What is claimed is:

1. In a centrifuge with a vertical axis of roation, having at least one skimmer in a skimming compartment in a centrifuge drum for continuously diverting a liquid phase being clarified or separated in the drum, a sealing disk rigidly connected to the skimmer above the skimming compartment and that extends into a blocking compartment rotating along with the drum and which is fillable with a blocking fluid, wherein the skimmer is stationary and the skimmer and the sealing disk are positioned at a distance from the rotating components of the drum, the improvement comprising: means providing fluid communication between the portions of the skimming and blocking compartments that are positioned below the sealing disk and above the skimmer; and means forming a channel connected to said portions of the skimming and blocking compartments and receptive of a gas at a higher than atmospheric pressure for shifting the fluid level in said portions radially outwardly from the vertical axis of rotation to prevent blocking fluid from entering the skimming compartment.

2. The centrifuge as in claim 1, wherein the channel is in the shank of the sealing disk.

* * * * *